US009530420B2

(12) United States Patent
Qi et al.

(10) Patent No.: US 9,530,420 B2
(45) Date of Patent: Dec. 27, 2016

(54) METHOD AND APPARATUS FOR ALLOCATING BITS OF AUDIO SIGNAL

(71) Applicant: Huawei Technologies Co., Ltd., Shenzhen (CN)

(72) Inventors: Fengyan Qi, Beijing (CN); Zexin Liu, Beijing (CN); Lei Miao, Beijing (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 14/675,031

(22) Filed: Mar. 31, 2015

(65) Prior Publication Data

US 2015/0206541 A1 Jul. 23, 2015

Related U.S. Application Data

(63) Continuation of application No. PCT/CN2013/076392, filed on May 29, 2013.

(30) Foreign Application Priority Data

Oct. 26, 2012 (CN) ..... 2012 1 0415253

(51) Int. Cl.
*G10L 19/002* (2013.01)
*G10L 19/035* (2013.01)
*G10L 19/02* (2013.01)

(52) U.S. Cl.
CPC ..... *G10L 19/002* (2013.01); *G10L 19/035* (2013.01); *G10L 19/0204* (2013.01)

(58) Field of Classification Search
CPC ..... G10L 19/002; G10L 19/032
See application file for complete search history.

(56) References Cited

U.S. PATENT DOCUMENTS 5,537,510 A 7/1996 Kim et al.
5,761,636 A 6/1998 Bolton et al.
(Continued)

FOREIGN PATENT DOCUMENTS

CN 101101755 A 1/2008
CN 102208188 A 10/2011
(Continued)

OTHER PUBLICATIONS

Foreign Communication From a Counterpart Application, Chinese Application No. 201210415253.6, Chinese Office Action dated Dec. 14, 2015, 3 pages.
(Continued)

*Primary Examiner* — Douglas Godbold
(74) *Attorney, Agent, or Firm* — Conley Rose, P.C.

(57) ABSTRACT

A method and an apparatus for allocating bits of an audio signal. The method includes dividing a frequency band of an audio signal into multiple sub-bands, and quantizing a sub-band normalization factor of each sub-band; classifying the multiple sub-bands into multiple groups, and acquiring a sum of intra-group sub-band normalization factors of each group; performing initial inter-group bit allocation to determine the initial number of bits of each group; performing secondary inter-group bit allocation to allocate coding bits of the audio signal to at least one group; and allocating the bits of the audio signal to sub-bands in the group. The present invention can, by means of grouping, ensure relatively stable allocation in a previous frame and a next frame and reduce an impact of global allocation on local discontinuity in a case of low and medium bit rates.

19 Claims, 4 Drawing Sheets

(56) References Cited

U.S. PATENT DOCUMENTS

| | | | | |
|---|---|---|---|---|
| 6,693,963 | B1 * | 2/2004 | Taniguchi | G10L 19/0208 375/240.11 |
| 6,745,162 | B1 | 6/2004 | Hu | |
| 2005/0149339 | A1 * | 7/2005 | Tanaka | G10L 21/038 704/500 |
| 2006/0172862 | A1 | 8/2006 | Badarneh et al. | |
| 2010/0202558 | A1 | 8/2010 | Hargreaves | |
| 2010/0296577 | A1 * | 11/2010 | Lien | G10L 19/16 375/240.03 |
| 2011/0035212 | A1 * | 2/2011 | Briand | G10L 19/0212 704/203 |
| 2011/0096830 | A1 | 4/2011 | Ashley et al. | |
| 2011/0264454 | A1 * | 10/2011 | Ullberg | G10L 21/038 704/500 |
| 2012/0116781 | A1 | 5/2012 | Matsumura et al. | |
| 2013/0018660 | A1 * | 1/2013 | Qi | G10L 19/002 704/500 |
| 2014/0219459 | A1 * | 8/2014 | Daniel | G10L 19/002 381/23 |

FOREIGN PATENT DOCUMENTS

| | | | |
|---|---|---|---|
| CN | 102467910 | A | 5/2012 |
| EP | 0720316 | A1 | 7/1996 |
| EP | 1073038 | A2 | 1/2001 |
| JP | 2000078018 | A | 3/2000 |
| JP | 2001044844 | A | 2/2001 |
| JP | 2001249699 | A | 9/2001 |
| JP | 2011501246 | A | 1/2011 |
| KR | 20060022257 | A | 3/2006 |

OTHER PUBLICATIONS

Foreign Communication From a Counterpart Application, Chinese Application No. 201210415253.6, Chinese Search Report dated Dec. 3, 2015, 2 pages.

Foreign Communication From a Counterpart Application, Korean Application No. 10-2015-7010413, Korean Office Action dated Nov. 20, 2015, 5 pages.

Foreign Communication From a Counterpart Application, Korean Application No. 10-2015-7010413, English Translation of Korean Office Action dated Nov. 20, 2015, 3 pages.

Partial English Translation and Abstract of Chinese Patent Application No. CN101101755A, Jun. 11, 2015, 22 pages.

Foreign Communication From a Counterpart Application, PCT Application No. PCT/CN2013/076392, English Translation of International Search Report dated Sep. 5, 2013, 3 pages.

Foreign Communication From a Counterpart Application, PCT Application No. PCT/CN2013/076392, English Translation of Written Opinion dated Sep. 5, 2013, 6 pages.

Foreign Communication From a Counterpart Application, Korean Application No. 10-2015-7010413, Korean Office Action dated May 19, 2016, 4 pages.

Foreign Communication From a Counterpart Application, Korean Application No. 10-2015-7010413, English Translation of Korean Office Action dated May 19, 2016, 3 pages.

Foreign Communication From A Counterpart Application, Japanese Application No. 2015-538257, Japanese Office Action dated Jul. 5, 2016, 3 pages.

Foreign Communication From A Counterpart Application, Japanese Application No. 2015-538257, Translation of Japanese Office Action dated Jul. 5, 2016, 2 pages.

Partial English Translation and Abstract of Japanese Patent Application No. JPA2000-078018, Aug. 10, 2016, 130 pages.

Partial English Translation and Abstract of Japanese Patent Application No. JPA2001-249699, Aug. 10, 2016, 36 pages.

Partial English Translation and Abstract of Japanese Patent Application No. JPA2001-044844, Aug. 10, 2016, 103 pages.

* cited by examiner

METHOD AND APPARATUS FOR ALLOCATING BITS OF AUDIO SIGNAL

CROSS-REFERENCE TO RELATED APPLICATION

This application is a continuation of International Application No. PCT/CN2013/076392, filed on May 29, 2013, which claims priority to Chinese Patent Application No. 201210415253.6, filed on Oct. 26, 2012, both of which are hereby incorporated by reference in their entireties.

TECHNICAL FIELD

Embodiments of the present invention relate to the field of audio technologies, and more specifically, to a method and an apparatus for allocating bits of an audio signal.

BACKGROUND

At present, increasing attention is paid to quality of audio in communication transmission, so it is required that, during coding and decoding, music quality be improved as far as possible on a premise of ensured quality of voice. Because information of a music signal is abundant, a code-excited linear prediction (CELP) coding mode for conventional voice cannot be used, and a transform coding method is usually used to process the music signal in a frequency domain, to improve coding quality of the music signal. However, it has now become a main subject of research on audio coding how to effectively use limited coding bits to encode information efficiently.

In current audio coding technologies, usually fast Fourier transform (FFT) or modified discrete cosine transform (MDCT) is used to transform a time domain signal to a frequency domain signal, and then the frequency domain signal is encoded. Usually, in transform coding, band division is performed on frequency domain coefficients, a normalized energy value of each band is obtained, intra-band coefficient energy values are normalized, and then bit allocation is performed, and finally intra-band coefficients are quantized according to bits that are allocated to each band, where bit allocation is a critical part. Bit allocation refers to, during a process of quantizing a frequency spectrum coefficient, bits that are of an audio signal and used to quantize the frequency spectrum coefficient are allocated to sub-bands according to sub-band features of a frequency spectrum.

An existing bit allocation process includes performing band division for frequency spectrum signals, for example, gradually increasing a bandwidth from a low frequency to a high frequency according to a critical frequency band theory; dividing a frequency spectrum into sub-bands, obtaining a normalized energy norm of each sub-band, and quantizing norm to obtain a sub-band normalization factor wnorm; sorting the sub-bands in descending order according to values of their sub-band normalization factors wnorm; and performing bit allocation, for example, allocating the number of bits iteratively for each sub-band according to the value of the sub-band normalization factor wnorm. The iterative bit allocation may further be divided into the following steps: step 1, initializing the number of bits of each sub-band and an iteration factor fac; step 2, finding a band corresponding to a greatest sub-band normalization factor wnorm; step 3, adding a bandwidth value to the number of bits allocated to this band, and subtracting the iteration factor fac from a value of the sub-band normalization factor wnorm; and step 4, repeating step 2 and step 3 until all bits are allocated. It can be seen that, in the prior art, a smallest unit of bits allocated each time is the bandwidth value, while the smallest number of bits needed during quantization is less than the bandwidth value, which results in low efficiency of such integral bit allocation when a bit rate is low, where many bands are allocated no bits, and other bands are allocated too many bits. Because bits are allocated iteratively in a full frequency band, iteration parameters are the same for sub-bands with different bandwidths, which results in a random allocation result, relatively scattered quantization, and discontinuity between a previous frame and a next frame.

It can be learned that, when a bit rate is low, bit allocation greatly affects performance. Usually, bit allocation is mainly performed in a full frequency band according to a magnitude of a normalized energy of each sub-band, and when a bit rate is low, such allocation is random and also relatively scattered, which causes a phenomenon of discontinuous quantization in a time domain.

SUMMARY

Embodiments of the present invention provide a method and an apparatus for allocating bits of an audio signal, which can resolve a problem of random and scattered allocation and discontinuous quantization in a time domain caused by an existing bit allocation method in a case of low and medium bit rates.

According to a first aspect, a method for allocating bits of an audio signal is provided and includes dividing a frequency band of an audio signal into multiple sub-bands, and quantizing a sub-band normalization factor of each sub-band; classifying the multiple sub-bands into multiple groups, and acquiring a sum of intra-group sub-band normalization factors of each group, where the sum of intra-group sub-band normalization factors of each group is a sum of sub-band normalization factors of all sub-bands in the group; performing initial inter-group bit allocation according to the sum of intra-group sub-band normalization factors of each group to determine the initial number of bits of each group; performing secondary inter-group bit allocation based on the initial number of bits of each group to allocate coding bits of the audio signal to at least one group, where a sum of bits allocated to the at least one group is the number of the coding bits of the audio signal; and allocating the bits of the audio signal that are allocated to the at least one group to sub-bands in the group.

With reference to the first aspect, in a first implementation manner of the first aspect, the performing secondary inter-group bit allocation includes performing the secondary inter-group bit allocation using a saturation algorithm for bit allocation.

With reference to the first implementation manner of the first aspect, in a second implementation manner of the first aspect, the performing the secondary inter-group bit allocation using a saturation algorithm for bit allocation includes determining the number of saturation bits of each group; determining a bit-saturated group and the number of surplus bits in the bit-saturated group according to the number of saturation bits of each group and the initial number of bits of each group, where the number of surplus bits in the bit-saturated group is the number of bits by which the initial number of bits in the bit-saturated group is greater than the number of saturation bits in the bit-saturated group; allocating the number of surplus bits to a non-bit-saturated group; where the bit-saturated group is a group in which the initial number of bits is greater than the number of saturation bits, and the non-bit-saturated group is a group in which the initial number of bits is less than the number of saturation bits.

With reference to the second implementation manner of the first aspect, in a third implementation manner of the first aspect, the allocating the number of surplus bits to a non-bit-saturated group includes allocating the number of surplus bits evenly to the non-bit-saturated group.

With reference to the first implementation manner, the second implementation manner, or the third implementation manner of the first aspect, in a fourth implementation manner of the first aspect, after the initial inter-group bit allocation and before the secondary inter-group bit allocation, the method further includes determining, according to a difference between average values of intra-group sub-band normalization factors and/or a bit rate, whether a saturation algorithm for bit allocation is to be used, where an average value of intra-group sub-band normalization factors is an average value of sub-band normalization factors of all sub-bands in a group; and if the average value of intra-group sub-band normalization factors is the average value of sub-band normalization factors of all sub-bands in the group, determining that a saturation algorithm for bit allocation is to be used, and if the average value of intra-group sub-band normalization factors is not the average value of sub-band normalization factors of all sub-bands in the group, determining that a weighting algorithm is to be used.

With reference to the first aspect or the fourth implementation manner of the first aspect, in a fifth implementation manner of the first aspect, the performing secondary inter-group bit allocation may further include performing the secondary inter-group bit allocation using a weighting algorithm.

With reference to the fifth implementation manner of the first aspect, in a sixth implementation manner of the first aspect, the performing the secondary inter-group bit allocation using a weighting algorithm includes weighting the sum of intra-group sub-band normalization factors of each group to obtain a weighted sum of intra-group sub-band normalization factors of each group; and performing the secondary inter-group bit allocation on the initial number of bits according to the weighted sum of intra-group sub-band normalization factors of each group.

With reference to the first aspect or any one of the foregoing implementation manners of the first aspect, in a seventh implementation manner of the first aspect, the allocating the bits of the audio signal that are allocated to the group to sub-bands in the group includes weighting the sub-band normalization factors to obtain weighted sub-band normalization factors; and allocating the bits of the audio signal that are allocated to the group to some or all of the sub-bands in the group according to the weighted sub-band normalization factors, where the some of the sub-bands are selected from all the sub-bands in the group in descending order according to the weighted sub-band normalization factors.

With reference to the first aspect or any one of the foregoing implementation manners of the first aspect, in an eighth implementation manner of the first aspect, the classifying the multiple sub-bands into multiple groups includes classifying sub-bands with a same bandwidth into one group, so that the multiple sub-bands are classified into multiple groups; or classifying sub-bands with close sub-band normalization factors into one group, so that the multiple sub-bands are classified into multiple groups.

With reference to the eighth implementation manner of the first aspect, in a ninth implementation manner of the first aspect, sub-bands in each group have a same bandwidth or close sub-band normalization factors.

According to a second aspect, an apparatus for allocating bits of an audio signal is provided and includes a sub-band quantizing unit configured to divide a frequency band of an audio signal into multiple sub-bands, and quantize a sub-band normalization factor of each sub-band; a grouping unit configured to classify the multiple sub-bands into multiple groups, and acquire a sum of intra-group sub-band normalization factors of each group, where the sum of intra-group sub-band normalization factors is a sum of sub-band normalization factors of all sub-bands in the group; a first allocating unit configured to perform initial inter-group bit allocation according to the sum of intra-group sub-band normalization factors of each group, to determine the initial number of bits of each group; a second allocating unit configured to perform secondary inter-group bit allocation based on the initial number of bits of each group, to allocate coding bits of the audio signal to at least one group, where a sum of bits allocated to the at least one group is the number of the coding bits of the audio signal; and a third allocating unit configured to allocate the bits of the audio signal that are allocated to the at least one group to sub-bands in the group.

With reference to the second aspect, in a first implementation manner of the second aspect, the second allocating unit is configured to perform the secondary inter-group bit allocation using a saturation algorithm for bit allocation.

With reference to the first implementation manner of the second aspect, in a second implementation manner of the second aspect, the second allocating unit includes a first determining module configured to determine the number of saturation bits of each group; a second determining module configured to determine a bit-saturated group and the number of surplus bits in the bit-saturated group according to the number of saturation bits of each group and the initial number of bits of each group, where the number of surplus bits in the bit-saturated group is the number of bits by which the initial number of bits in the bit-saturated group is greater than the number of saturation bits in the bit-saturated group; and an allocating module configured to allocate the number of surplus bits to a non-bit-saturated group; where the bit-saturated group is a group in which the initial number of bits is greater than the number of saturation bits, and the non-bit-saturated group is a group in which the initial number of bits is less than the number of saturation bits.

With reference to the second implementation manner of the second aspect, in a third implementation manner of the second aspect, the allocating module is configured to allocate the number of surplus bits evenly to the non-bit-saturated group.

With reference to the first implementation manner, the second implementation manner, or the third implementation manner of the second aspect, in a fourth implementation manner of the second aspect, the apparatus for allocating bits of an audio signal further includes a determining unit configured to, after the initial inter-group bit allocation and before the secondary inter-group bit allocation, determine, according to a difference between average values of intra-group sub-band normalization factors and/or a bit rate, whether a saturation algorithm for bit allocation is to be used, where an average value of intra-group sub-band normalization factors is an average value of sub-band normalization factors of all sub-bands in a group; and if the average value of intra-group sub-band normalization factors is the average value of sub-band normalization factors of all sub-bands in the group, determine that a saturation algorithm for bit allocation is to be used, and if the average value of intra-group sub-band normalization factors is not the average value of sub-band normalization factors of all sub-bands in the group, determine that a weighting algorithm is to be used.

With reference to the second aspect or the fourth implementation manner of the second aspect, in a fifth implementation manner of the second aspect, the second allocating unit is further configured to perform the secondary inter-group bit allocation using a weighting algorithm.

With reference to the fifth implementation manner of the second aspect, in a sixth implementation manner of the second aspect, the second allocating unit further includes a weighting module configured to weight the sum of intra-group sub-band normalization factors of each group to obtain a weighted sum of intra-group sub-band normalization factors of each group; and the allocating module is configured to perform the secondary inter-group bit allocation on the initial number of bits according to the weighted sum of intra-group sub-band normalization factors of each group.

With reference to the second aspect or any one of the foregoing implementation manners of the second aspect, in a seventh implementation manner of the second aspect, the third allocating unit includes a weighting module configured to weight the sub-band normalization factors to obtain weighted sub-band normalization factors; and an allocating module configured to allocate the bits of the audio signal that are allocated to the group to some or all of the sub-bands in the group according to the weighted sub-band normalization factors, where the some of the sub-bands are selected from all the sub-bands in the group in descending order according to the weighted sub-band normalization factors.

With reference to the second aspect or any one of the foregoing implementation manners of the second aspect, in an eighth implementation manner of the second aspect, the grouping unit is configured to classify sub-bands with a same bandwidth into one group, so that the multiple sub-bands are classified into multiple groups; or classify sub-bands with close sub-band normalization factors into one group, so that the multiple sub-bands are classified into multiple groups.

With reference to the eighth implementation manner of the second aspect, in a ninth implementation manner of the second aspect, sub-bands in each group have a same bandwidth or close sub-band normalization factors.

The embodiments of the present invention can, by means of grouping, ensure relatively stable allocation in a previous frame and a next frame and reduce an impact of global allocation on local discontinuity in a case of low and medium bit rates.

BRIEF DESCRIPTION OF DRAWINGS

To describe the technical solutions in the embodiments of the present invention more clearly, the following briefly introduces the accompanying drawings required for describing the embodiments. The accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the embodiments of the present invention with reference to the accompanying drawings in the embodiments of the present invention. The described embodiments are some but not all of the embodiments of the present invention. All other embodiments obtained by a person of ordinary skill in the art based on the embodiments of the present invention without creative efforts shall fall within the protection scope of the present invention.

Coding technical solutions and decoding technical solutions are widely applied to various electronic devices, for example, mobile phones, wireless apparatuses, personal data assistants (PDA), handheld or portable computers, global positioning system (GPS) receivers/navigators, cameras, audio/video players, video cameras, video tape recorders, and monitoring devices. Generally, such electronic devices include an audio encoder or an audio decoder, where the audio encoder or decoder may be directly implemented by a digital circuit or a chip, for example, a digital signal processor (DSP), or be implemented by software code driving a processor to execute a process in the software code.

As an example, in an audio coding technology solution, first, a time domain audio signal is transformed to a frequency domain signal, then coding bits are allocated to the frequency domain audio signal for coding, and a coded signal is transmitted to a decoder through a communications system, and the decoder decodes and restores the coded signal.

In the present invention, bit allocation is performed according to a grouping theory and signal characteristics. First, bands are grouped, and then, an intra-group energy is weighted according to a characteristic of each group, and bit allocation is performed for each group according to the weighted energy, and then, bits are allocated to each band according to an intra-group signal characteristic. Because allocation is first performed for an entire group, a phenomenon of discontinuous allocation is prevented, thereby improving coding quality of different signals. Moreover, because a signal characteristic is considered when allocation is performed in a group, limited bits can be allocated to an important audio band that affects perception.

Figure 1:
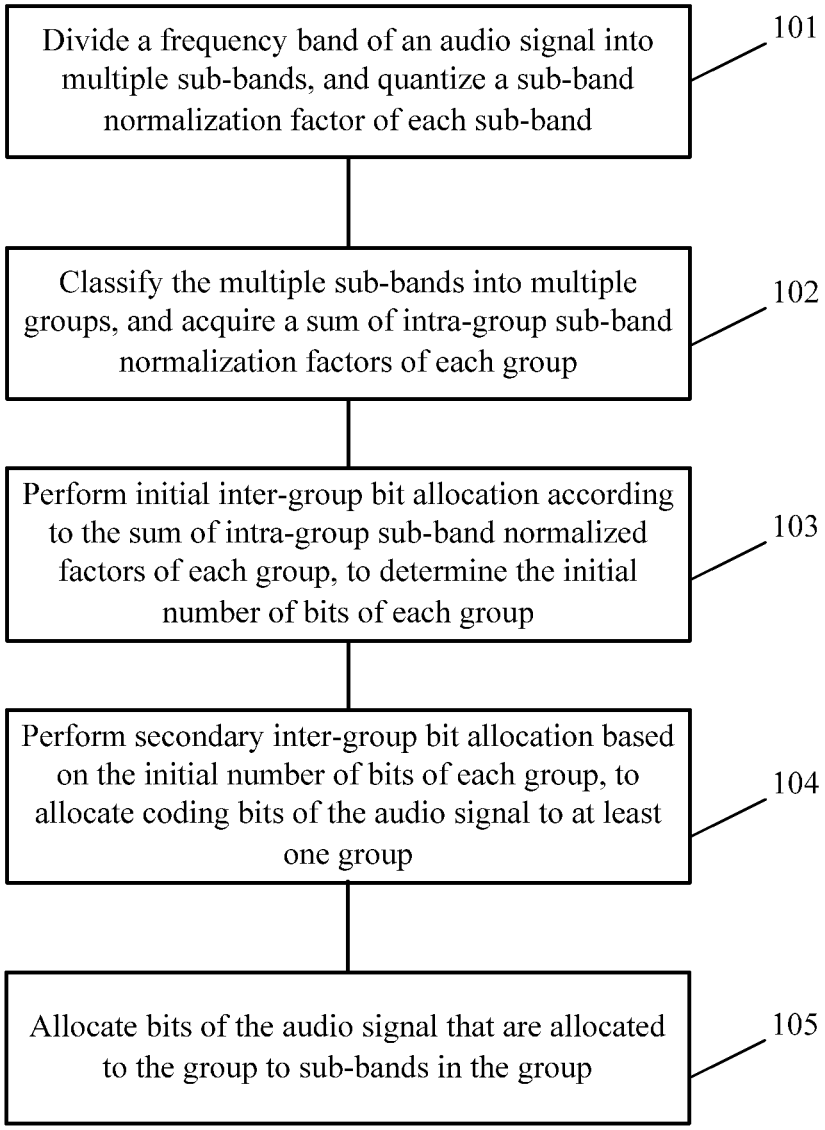
FIG. 1 is a flowchart of a method for allocating bits of an audio signal according to an embodiment of the present invention.

FIG. 1 is a flowchart of a method for allocating bits of an audio signal according to an embodiment of the present invention.

101. Divide a frequency band of an audio signal into multiple sub-bands, and quantize a sub-band normalization factor of each sub-band.

The following is described using MDCT transform as an example. First, MDCT transform is performed on an input audio signal, to obtain a frequency domain coefficient. The MDCT transform herein may include several processes: windowing, time domain aliasing, and discrete DCT transform.

For example, a sine window is added to an input time domain signal x(n):

$$h(n) = \sin\left[\left(n + \frac{1}{2}\right)\frac{\pi}{2L}\right], \quad n = 0, \ldots, 2L-1, \quad \text{where } L \text{ is a frame length of the signal} \tag{1}$$

The following windowed signal is obtained:

$$x_w(n) = \begin{cases} h(n)x_{OLD}(n), & n = 0, \ldots, L-1 \\ h(n)x(n-L), & n = L, \ldots, 2L-1 \end{cases} \tag{2}$$

Then, a time domain aliasing operation is performed:

$$\tilde{x} = \begin{bmatrix} 0 & 0 & -J_{L/2} & -I_{L/2} \\ I_{L/2} & -J_{L/2} & 0 & 0 \end{bmatrix} x_w \tag{3}$$

$I_{L/2}$ and $J_{L/2}$ herein are each represented as a diagonal matrix with an order of L/2:

$$I_{L/2} = \begin{bmatrix} 1 & & 0 \\ & \ddots & \\ 0 & & 1 \end{bmatrix}, J_{L/2} = \begin{bmatrix} 0 & & 1 \\ & \iddots & \\ 1 & & 0 \end{bmatrix} \tag{4}$$

Discrete DCT transform is performed on the time domain aliased signal, to finally obtain a frequency domain MDCT coefficient:

$$y(k) = \sum_{n=0}^{L-1} \tilde{x}(n)\cos\left[\left(n + \frac{1}{2}\right)\left(k + \frac{1}{2}\right)\frac{\pi}{L}\right], k = 0, \ldots, L-1. \tag{5}$$

Then a frequency envelope is extracted from the MDCT coefficient and quantized. An entire frequency band is divided into some sub-bands with different frequency domain resolutions, a normalization factor of each sub-band is extracted, and sub-band normalization factors are quantized.

For example, an audio signal sampled at 16 kiloHertz (kHz) corresponds to a frequency band with an 8 kHz bandwidth, and if a frame length is 20 milliseconds (ms) and there are 3,200 frequency spectrum coefficients in total, the band can be divided into the following 26 sub-bands: 8, 8, 8, 8, 8, 8, 8, 8, 8, 8, 8, 8, 8, 8, 8, 8, 16, 16, 16, 16, 16, 16, 16, 16, 24, 24.

First, several groups are obtained by means of division, and then sub-bands in a group are further obtained by means of division. A normalization factor of each sub-band may be defined as follows:

$$\text{Norm}(p) = \sqrt{\frac{1}{L_p}\sum_{k=s_p}^{e_p} y(k)^2}, \; p = 0, \ldots, P-1. \tag{6}$$

$L_p$ herein is the number of coefficients in a sub-band, $s_p$ is a start point of the sub-band, $e_p$ is an end point of the sub-band, and P is the total number of sub-bands.

After being obtained, the normalization factor may be quantized in a logarithmic domain, to obtain a quantized sub-band normalization factor wnorm.

102. Classify the foregoing multiple sub-bands into multiple groups, and acquire a sum of intra-group sub-band normalization factors of each group, where the sum of intra-group sub-band normalization factors is a sum of sub-band normalization factors of all sub-bands in the group.

That is, all the sub-bands are classified into multiple groups, and a group parameter of each group is obtained, where the group parameter may be the sum of intra-group sub-band normalization factors that is used to represent a signal characteristic and an energy attribute of this group.

Herein, it is considered that sub-bands with similar features and energies are classified into one group. For example, sub-bands with a same bandwidth may be classified into one group, and preferably, sub-bands that are adjacent and have a same bandwidth are classified into one group. For example, all sub-bands may be classified into three groups, and therefore, when a bit rate is low, only the first one group or two groups are used, and bit allocation is not performed for the remaining groups.

Alternatively, grouping may be performed according to a relationship between normalized energies norm of sub-bands. That is, sub-bands with close sub-band normalization factors wnorm may be classified into one group. For example, whether sub-band normalization factors of sub-bands are close may be determined using the following method: comparing a sub-band normalization factor wnorm [i] (i=1, . . . , P−1, where P is the total number of sub-bands) of a sub-band with a predetermined threshold K. If wnorm[i] is greater than the predetermined threshold K, a sequence number i of the sub-band is recorded, and finally sub-bands whose sub-band normalization factors wnorm[i] are greater than the predetermined threshold K are classified into one group, and the remaining sub-bands are classified into another group. It should be understood that, multiple predetermined thresholds may be set according to different requirements, so that more groups are obtained.

Optionally, adjacent sub-bands with close sub-band normalization factors may also be classified into one group. For example, whether sub-band normalization factors of adjacent sub-bands are close may be determined using the following method: first, a difference wnorm_diff[i] of sub-band normalization factors of adjacent sub-bands is calculated, where wnorm_diff[i]=abs(wnorm[i]−wnorm[i−1]), and i=1, . . . , P−1, where P is the total number of sub-bands. If wnorm_diff[i] is less than a predetermined threshold K', it indicates that the sub-band normalization factors of the adjacent sub-bands are close, so that sequence numbers of adjacent sub-bands that can be classified into one group are determined.

Once sub-band grouping is complete, a group parameter of each group may be obtained, to represent an energy attribute of the group. Generally, the group parameter may include one or more of the following: group_wnorm, a sum of intra-group sub-band normalization factors, and group_sharp, a peak-to-average ratio of intra-group sub-band normalization factors.

Further, group_wnorm, the sum of intra-group sub-band normalization factors, is a sum of sub-band normalization factors of all sub-bands in a group, that is, $$\text{group_wnorm}[i] = \sum_{b=S_i}^{E_i} \text{wnorm}[b],$$

where $S_i$ is a start sub-band in the $i^{th}$ group, and $E_i$ is an end sub-band in the $i^{th}$ group.

An average value of intra-group sub-band normalization factors, group_avg, is an average value of sub-band normalization factors of all sub-bands in a group, that is, $$\text{group_avg}[i] = \frac{\text{group_wnorm}[i]}{E_i - S_i + 1},$$

where group_wnorm[i] is a sum of intra-group sub-band normalization factors of the $i^{th}$ group, $S_i$ is a start sub-band in the $i^{th}$ group, and $E_i$ is an end sub-band in the $i^{th}$ group.

103. Perform initial inter-group bit allocation according to the sum of intra-group sub-band normalization factors of each group, to determine the initial number of bits of each group.

The foregoing group parameter represents an energy attribute of a group, so that bits of an audio signal may be allocated to each group according to the group parameter. In this way, when a bit rate is low, a grouping theory is used, and energy attributes of groups are considered, so that allocation of bits of the audio signal is more concentrated, and bit allocation between frames is more continuous. It should be understood that, the group parameter is not limited to the several types listed herein, and it may also be another parameter that can represent an energy attribute of a group.

In one embodiment, when a bit rate is low, bits are allocated to only some of the groups. For example, for a group with a sum of intra-group sub-band normalization factors being 0, bits are not allocated to this group; and for another example, when the number of bits is small, there may also be a group to which no bits are allocated. That is, on a basis that the foregoing group parameter is obtained, coding bits may be allocated for at least one group according to only a sum of intra-group sub-band normalization factors of each group, where a sum of bits allocated to the at least one group is bits of the audio signal.

According to the group_wnorm[i] of each group, the initial number of bits allocated to each group is obtained. A simplest method is to allocate the number of bits according to a ratio of the sum of intra-group sub-band normalization factors of each group to a normalized energy of all sub-bands of the group, that is, the initial number of bits of the $i^{th}$ group, Bi=sum_bits*group_wnorm[i]/sum_norm, where sum_bits is the total number of to-be-allocated bits, and sum_norm is the normalized energy of all sub-bands.

104. Perform secondary inter-group bit allocation based on the initial number of bits of each group, to allocate coding bits of the audio signal to at least one group, where a sum of bits allocated to the at least one group is the coding bits of the audio signal, or a sum of bits allocated to the at least one group is the number of quantization bits of the audio signal, where the quantization bits are bits for quantizing a frequency spectrum coefficient.

After the initial number of bits of each group is determined, the secondary inter-group bit allocation may be performed.

For example, the secondary inter-group bit allocation may be performed using a saturation algorithm for bit allocation.

First, the number of saturation bits of each group is determined, where the number of saturation bits is generally an empirical value, for example, averagely 1 to 2 bits for each frequency spectrum coefficient. In addition, the number of saturation bits may further be related to a coding rate and a signal characteristic. Then, a bit-saturated group and the number of surplus bits in the bit-saturated group are determined according to the number of saturation bits of each group and the foregoing initial number of bits of each group, and finally, the number of surplus bits is allocated to a non-bit-saturated group. For example, the number of surplus bits may be evenly allocated to the non-bit-saturated group. Herein, the bit-saturated group is a group in which the initial number of bits is greater than the number of saturation bits, and the non-bit-saturated group is a group in which the initial number of bits is less than the number of saturation bits. The number of surplus bits in the bit-saturated group is the number of bits by which the initial number of bits in the bit-saturated group is greater than the number of saturation bits in the bit-saturated group.

Alternatively, for example, the secondary inter-group bit allocation may be performed using a weighting algorithm.

That is, a result of allocating bits of the audio signal to each group is optimized by adjusting a group parameter. For example, different weights are allocated to group parameters of different groups according to different allocation requirements, so that a limited number of bits are allocated to a proper group, and then the bits are allocated in the group, so that bit allocation is no longer scattered, which facilitates coding of the audio signal.

An implementation manner is given exemplarily below. For example, a sum of intra-group sub-band normalization factors of each group is weighted, and a weighted sum of intra-group sub-band normalization factors of each group is obtained; and secondary inter-group bit allocation is performed for the initial number of bits according to the weighted sum of intra-group sub-band normalization factors of each group.

Another implementation manner is given exemplarily below. For example, after group_wnorm, a sum of intra-group sub-band normalization factors of each group, and group_sharp, a peak-to-average ratio of intra-group sub-band normalization factors of each group, are acquired, group_wnorm, the sum of intra-group sub-band normalization factors, may be weighted, according to group_sharp, the peak-to-average ratio of intra-group sub-band normalization factors, to obtain group_wnorm_w, a weighted sum of intra-group sub-band normalization factors.

Further, two adjacent groups, for example, the first group and the second group, are selected successively from groups from a low frequency to a high frequency. A peak-to-average ratio of intra-group sub-band normalization factors of the first group, group_sharp[i], is compared with a peak-to-average ratio of intra-group sub-band normalization factors of the second group, group_sharp[i−1]. If a difference of the peak-to-average ratio of intra-group sub-band normalization factors of the first group relative to the peak-to-average ratio of intra-group sub-band normalization factors of the second group is greater than a first threshold, a sum of intra-group sub-band normalization factors of the first group is adjusted according to a first weighting factor, and a sum of intra-group sub-band normalization factors of the second group is adjusted according to a second weighting factor; and if a difference of the peak-to-average ratio of intra-group sub-band normalization factors of the second group relative to the peak-to-average ratio of intra-group sub-band normalization factors of the first group is greater than a second threshold, the sum of intra-group sub-band normalization factors of the second group is adjusted according to the first weighting factor, and the sum of intra-group sub-band normalization factors of the first group is adjusted according to the second weighting factor.

For example, if group_sharp[i]−group_sharp[i−1]>a, group_wnorm_w[i−1]=b*group_wnorm[i−1], and group_wnorm_w[i]=(b−1)*group_wnorm[i], or if group_sharp[i−1]−group_sharp[i]>c, group_wnorm_w[i]=b*group_wnorm[i], and group_wnorm[i−1]=(b−1)*group_wnorm[i−1], where a group sequence number i=1, . . . , P−1, where P is the total number of sub-bands; b is a weight; a is a first threshold; and c is a second threshold. It should be understood that selection of a, b and c may be performed as required by bit allocation.

Herein, only a simple weighting method is described exemplarily. A person skilled in the art can readily figure out another weighting method, to adjust sub-band weights using different weighting coefficients. For example, a weight of a sub-band that needs to be allocated more signal bits may be increased, and that of a sub-band that does not need to be allocated any bit or needs to be allocated fewer signal bits is reduced.

Then, bits of the audio signal are allocated to each group according to the weighted sum of intra-group sub-band normalization factors. For example, the number of group bits of the group is determined according to a ratio of group_wnorm[i], the weighted sum of intra-group sub-band normalization factors, to sum_wnorm, a sum of sub-band normalization factors of all sub-bands, and the bits of the audio signal are allocated to the group according to the determined number of group bits. The total number of bits of each group, group_bits, is determined according to the following formula: group_bits[i]=sum_bits*group_wnorm[i]/sum_wnorm, where sum_bits is the total number of bits of the audio signal that need to be allocated, and sum_wnorm is the sum of sub-band normalization factors of all the sub-bands.

A process of the foregoing secondary inter-group bit allocation may be further optimized. For example, different secondary inter-group bit allocation solutions, such as a saturation algorithm and a weighting algorithm, are used according to a bit rate and/or a difference between average values of intra-group sub-band normalization factors.

For example, whether a saturation algorithm or a weighting algorithm for bit allocation is to be used is determined according to a difference between average values of intra-group sub-band normalization factors and/or a bit rate, where an average value of intra-group sub-band normalization factors is an average value of sub-band normalization factors of all sub-bands in a group.

After bits are allocated to groups, bits that are allocated to each group may be further allocated to sub-bands in the group.

105. Allocate the bits of the audio signal that are allocated to the group to sub-bands in the group.

It should be understood that bit allocation may be performed for sub-bands in a group using an existing iterative allocation method. However, the iterative allocation method still causes a random result of intra-group bit allocation, and discontinuity between a previous frame and a next frame. Therefore, the bits of the audio signal that are allocated to the group, may be allocated, according to sub-band normalization factors of sub-bands in the group, to the sub-bands in the group with reference to signal characteristics of different audio signals, that is, different signal types.

One implementation manner is weighting the sub-band normalization factors to obtain weighted sub-band normalization factors; and allocating the bits of the audio signal that are allocated to the group to some or all of the sub-bands in the group according to the weighted sub-band normalization factors, where the some of the sub-bands are selected from all the sub-bands in the group in descending order according to the weighted sub-band normalization factors.

A typical implementation manner in which the bits of the audio signal that are allocated to the group are allocated to all the sub-bands in the group according to the weighted sub-band normalization factors is, after determining the weighted sub-band normalization factors of all the sub-bands, calculating to obtain a sum of the weighted sub-band normalization factors of all the sub-bands in the group, and then allocating, according to a ratio of the weighted sub-band normalization factors of a sub-band that needs to be allocated bits to the sum of the weighted sub-band normalization factors of all the sub-bands, the bits that are allocated to the group to a specific sub-band.

A typical implementation manner in which the bits of the audio signal that are allocated to the group are allocated to some of the sub-bands in the group according to the weighted sub-band normalization factors is sorting the weighted sub-band normalization factors of all the sub-bands in the group, for example, in descending order; selecting, according to the sorting of the weighted sub-band normalization factors, some of the sub-bands corresponding to the weighted sub-band normalization factors that rank higher; and allocating the bits of the audio signal that are allocated to the group to the some of the sub-bands in the group.

For example, first, weighting parameters factor[0] and factor[1] of sub-band normalization factors wnorm of the sub-bands in the group are determined, the sub-band normalization factors wnorm of the sub-bands in the group are sorted to obtain wnorm_index[i], and wnorm_index[i] is weighted using a weighting parameter, and finally bit allocation is performed for the sub-bands in the group according to the weighted wnorm_index[i].

It may be learned from the foregoing that, according to the method for allocating bits of an audio signal in this embodiment of the present invention, relatively stable allocation in a previous frame and a next frame can be ensured by means of grouping, thereby reducing an impact of global allocation on local discontinuity; and surplus bits of a saturated sub-band are effectively used by means of secondary allocation, so that bit allocation is more reasonable.

The following describes in detail, with reference to a programming language in specific embodiments, how to use different secondary inter-group bit allocation solutions according to a bit rate and/or a difference between average values of intra-group sub-band normalization factors, and then perform bit allocation for sub-bands in a group.

First, multiple sub-bands of an audio signal are classified into multiple groups, and the initial number of bits allocated to each group is obtained according to group_wnorm[i], a sum of sub-band normalization factors of each group. For example, all sub-bands are classified into three groups: the initial number of bits of the first group, B1=sum_bits*group_wnorm[0]/sum_norm, the initial number of bits of the second group, B2=sum_bits* group_wnorm[1]/sum_norm, and the initial number of bits of the third group, B3=sum_bits* group_wnorm[2]/sum_norm, where sum_bits is the total number of to-be-allocated bits; therefore, B3=sum_bits−B1−B2, and sum_norm=group_wnorm[0]+group_wnorm[1]+group_wnorm[2].

Then, different secondary inter-group bit allocation solutions are used according to a bit rate (bit_rate) and a difference between average values of intra-group sub-band normalization factors (avg_diff).

Step 1. Calculate a difference between average values of intra-group sub-band normalization factors: avg_diff[0]=group_avg[0]−group_avg[1]; and avg_diff[1]=group_avg[1]−group_avg[2].

Step 2. Select a secondary inter-group bit allocation solution, for example, determine, according to two conditions, that is, a difference between average values of intra-group sub-band normalization factors and/or a bit rate, whether a saturation algorithm or a weighting algorithm for bit allocation is to be used:

```
if (bit_rate > a && avg_diff[0] < b && avg_diff[1] < c)
{
  saturation algorithm
}
else
{
  weighting algorithm
}, where
a, b, and c are empirical factors.
```

Step 3. Post-processing algorithm: if group_wnorm[2] of a highest sub-band is less than a specific value, allocate bits allocated to the group to a group of lower sub-bands. For example, when group_wnorm[2] is less than a threshold d, bits allocated to the highest sub-band are allocated to a second highest sub-band, and the number of bits allocated to the highest sub-band is set to zero.

For a saturation algorithm: a principle is that when bits allocated to a group are close to saturation, surplus bits are allocated to other groups. For example:

1) First, set the numbers of saturation bits of the groups to B1_UP, B2_UP, and B3_UP respectively.

2) Calculate surplus bits:

```
B_saved = 0;
if (B1 > B1_UP)
{
B_saved = B_saved + (B1 − B1_UP);
B1 = B1_UP;
}
if (B2 > B2_UP)
{
B_saved = B_saved + (B2 − B2_UP);
B2 = B2_UP;
}
if (B3 > B3_UP)
{
B_saved = B_saved + (B3 − B3_UP);
B3 = B3_UP;
}, where
B1_UP, B2_UP, and B3_UP are empirical factors,
and may be 288, 256, and 96 respectively.
```

3) Allocate the surplus bits for a second time. For example, when the bits allocated to the first group are close to saturation, B_saved is evenly allocated to other groups, and if the bits allocated to the first group are not saturated, half of B_saved are added to B1; and then it is determined whether bits allocated to the second group are saturated, and if the bits allocated to the first group are not saturated, B2 is set to sum_bits−B1−B3, or B3 is set to sum_bits−B1−B2, and pseudocode of the algorithm is as follows:

```
if (B_saved > 0)
{
if (B1 == B1_UP)
{
```

-continued

```
B2 = B2 + B_saved/2;
B3 = sum_bits − B1 − B2;
}
else
{
B1 = B1 + B_saved/2;
if (B2 == B2_UP)
{
B3 = sum_bits − B1 − B2;
}
else
{
B2 = sum_bits − B1− B3;
}
}
}
```

For a weighting algorithm:

B1'=a1*B1,

B2'=a2*B2, and

B3'=sum_bits−B1'−B2', where sum_bits is the total number of bits, and sum_norm=group_wnorm[0]+group_wnorm[1]+group_wnorm[2], where a1 and a2 are weighting coefficients, for example, may be set to a1=1.0 and a2=0.92 herein.

Finally, bits that are allocated to the groups are allocated to sub-bands in the groups using the following method.

Step 1. Determine a weighting parameter factor[ ] of a sub-band normalization factor wnorm of sub-bands in each group, for example, factor[0]=FAC1, and factor[1]=FAC2, where FAC1, FAC2 are empirical factors, and may be 2.0 and 1.5, 2.0 and 3.0, or the like respectively.

Step 2. Sort all sub-band normalization factors wnorm in the group in descending order, to obtain wnorm_index(i).

Step 3. Perform, according to the weighting parameter factor[ ], the following weighting processing on values of wnorm_index(i) after the sorting: wnorm_index(i)=wnorm_index(i)*(α−β*i), 0≤i<band_num, where band_num is the number of sub-bands included in the group, α and β may be set according to a condition, for example, different values may be set according to different groups; it may be set that α=factor[0] and $$\beta = \frac{1}{\text{band_num}}$$

in a case of a low frequency component of the first group, and in a case of a group with a higher frequency than the first group, it may be set that α=factor[1] and $$\beta = \frac{1}{\text{band_num}}.$$

Step 4. Allocate bits that are allocated to the group to sub-bands in the group again according to the values of wnorm_index(i) after the sorting.

Step 4.1. Divide the total number of bits in the group, Bx, by a threshold Thr, to obtain BitBand_num, the number of sub-bands that are initially allocated to the group.

Step 4.2. Determine the number of sub-bands N for bit allocation according to a relationship between BitBand_num, the number of sub-bands that are initially allocated to the group, and sumBand_num, the total number of sub-bands in the group. For example, if BitBand_num is greater than k*sumBand_num, where k is a coefficient, such as 0.75 or 0.8, N is equal to sumBand_num; otherwise, N is equal to BitBand_num.

Step 4.3. Select the first N sub-bands, where N is the number of sub-bands in the group, for which bit allocation is performed.

Step 4.4. Initialize the number of bits of the N sub-bands to 1, and initialize the number of iterations j to 0.

Step 4.5. Determine band_wnorm, a sum of sub-band normalization factors of sub-bands that are among the N sub-bands and whose sub-band normalization factors are greater than 0.

Step 4.6. Allocate the number of bits to the sub-bands that are among the N sub-bands and whose sub-band normalization factors are greater than 0: band_bits[i]= Bx*wnorm_index(i)/band_wnorm; where Bx is the number of bits that are allocated to each group, for example, in the foregoing embodiments, the numbers of bits for the three groups are B1, B2, and B3 respectively.

Step 4.7. Determine whether the number of bits allocated to the last sub-band of the N sub-bands is less than a fixed threshold fac, and if it is less than the fixed threshold fac, set the number of bits allocated to the sub-band to zero; if it is greater than or equal to fac, go to step 4.9; otherwise, go to step 4.8.

Step 4.8. Add 1 to the number of iterations j; and repeat step 4.5 to step 4.8 until the number of iterations j is equal to N.

Step 4.9. Restore an original order of all sub-bands in the group, that is, restore an order of all the sub-bands to that before the sub-band normalization factor of each sub-band is quantized.

It is understandable that the method for bit allocation in a group according to this embodiment of the present invention is not limited to the foregoing example that is described in step 4.1 to 4.9.

Using the grouping manner in this embodiment of the present invention, relatively stable allocation in a previous frame and a next frame is ensured, and bit allocation with different emphases is performed in a group according to signal characteristics, so that allocated bits are all used to quantize important frequency spectrum information, thereby improving coding quality of an audio signal.

It may be learned from the foregoing that, according to the method for allocating bits of an audio signal in this embodiment of the present invention, relatively stable allocation in a previous frame and a next frame can be ensured by means of grouping, thereby reducing an impact of global allocation on local discontinuity. In addition, a different threshold parameter may be set for bit allocation in each group, so that bit allocation is more adaptive. Moreover, bit allocation with different emphases is performed in a group according to frequency spectrum signal characteristics. For example, for a quasi-harmonic signal with a centralized frequency spectrum, bits are mainly allocated to sub-bands with high energies, and there is no need to allocate more bits to a sub-band between harmonics; for a signal with a relatively flat frequency spectrum, smoothness between sub-bands is ensured as far as possible during bit allocation, so that allocated bits are all used to quantize important frequency spectrum information.

Figure 2:
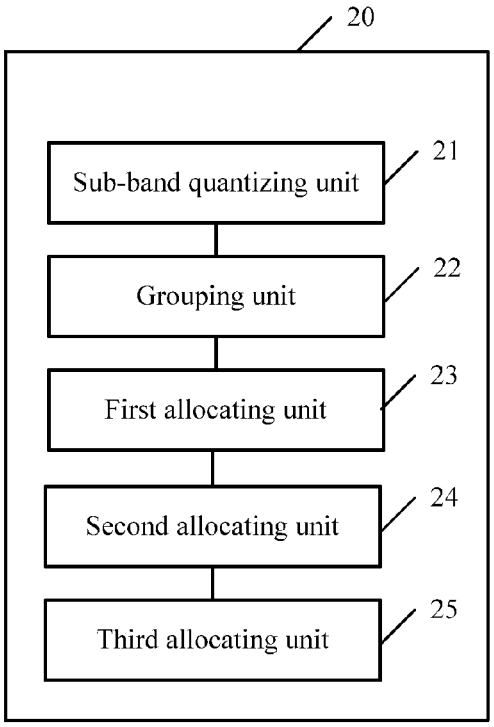
FIG. 2 is a schematic structural diagram of an apparatus for allocating bits of an audio signal according to an embodiment of the present invention.

With reference to FIG. 2, the following describes a schematic structure of an apparatus for allocating bits of an audio signal according to an embodiment of the present invention.

In FIG. 2, an apparatus 20 for allocating bits of an audio signal includes a sub-band quantizing unit 21, a grouping unit 22, a first allocating unit 23, a second allocating unit 24, and a third allocating unit 25.

The sub-band quantizing unit 21 is configured to divide a frequency band of an audio signal into multiple sub-bands, and quantize a sub-band normalization factor of each sub-band.

The grouping unit 22 is configured to classify the multiple sub-bands into multiple groups, and acquire a sum of intra-group sub-band normalization factors of each group, where the sum of intra-group sub-band normalization factors is a sum of sub-band normalization factors of all sub-bands in the group.

Optionally, the grouping unit 22 is configured to classify sub-bands with a same bandwidth into one group, so that the multiple sub-bands are classified into multiple groups; or classify sub-bands with close sub-band normalization factors into one group, so that the multiple sub-bands are classified into multiple groups. Preferably, sub-bands in each group have a same bandwidth or close sub-band normalization factors.

The first allocating unit 23 is configured to perform initial inter-group bit allocation according to the sum of intra-group sub-band normalization factors of each group, to determine the initial number of bits of each group.

The second allocating unit 24 is configured to perform secondary inter-group bit allocation based on the initial number of bits of each group, to allocate coding bits of the audio signal to at least one group, where a sum of bits allocated to the at least one group is the number of the coding bits of the audio signal.

Figure 3:
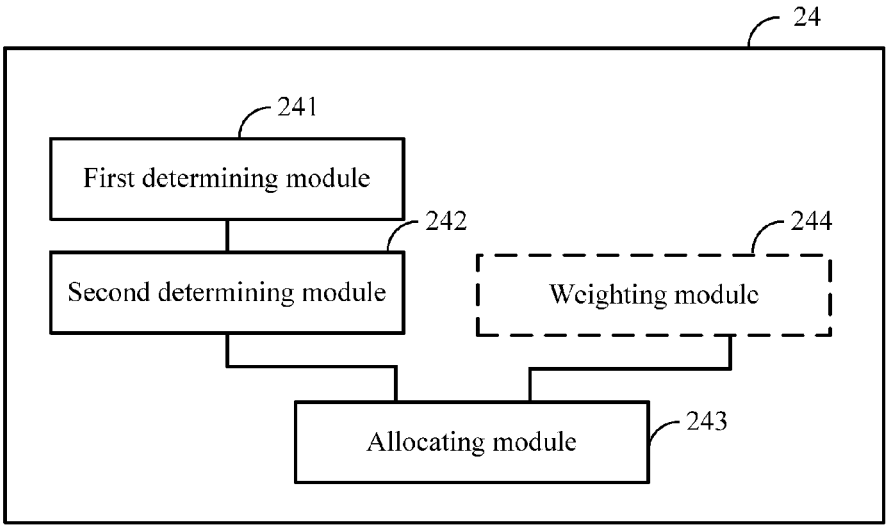
FIG. 3 is a schematic structural diagram of a second allocating unit in an apparatus for allocating bits of an audio signal according to an embodiment of the present invention.

Optionally, the second allocating unit 24 may be configured to perform the secondary inter-group bit allocation using a saturation algorithm for bit allocation. For example, as shown in FIG. 3, the second allocating unit 24 may include a first determining module 241, a second determining module 242, and an allocating module 243, where the first determining module 241 is configured to determine the number of saturation bits of each group; the second determining module 242 is configured to determine a bit-saturated group and the number of surplus bits in the bit-saturated group according to the number of saturation bits of each group and the initial number of bits of each group, where the number of surplus bits in the bit-saturated group is the number of bits by which the initial number of bits in the bit-saturated group is greater than the number of saturation bits in the bit-saturated group; and the allocating module 243 is configured to allocate the number of surplus bits to a non-bit-saturated group, where the bit-saturated group is a group in which the initial number of bits is greater than the number of saturation bits, and the non-bit-saturated group is a group in which the initial number of bits is less than the number of saturation bits. Optionally, the allocating module 243 may be configured to allocate the number of surplus bits evenly to the non-bit-saturated group.

Alternatively, optionally, the second allocating unit may be configured to perform the secondary inter-group bit allocation using a weighting algorithm. For example, the second allocating unit 24 may further include a weighting module 244 and an allocating module 243, where the weighting module 244 is configured to weight the sum of intra-group sub-band normalization factors of each group, to obtain a weighted sum of intra-group sub-band normalization factors of each group; and the allocating module 243 is configured to perform the secondary inter-group bit allocation on the initial number of bits according to the weighted sum of intra-group sub-band normalization factors of each group.

Figure 4:
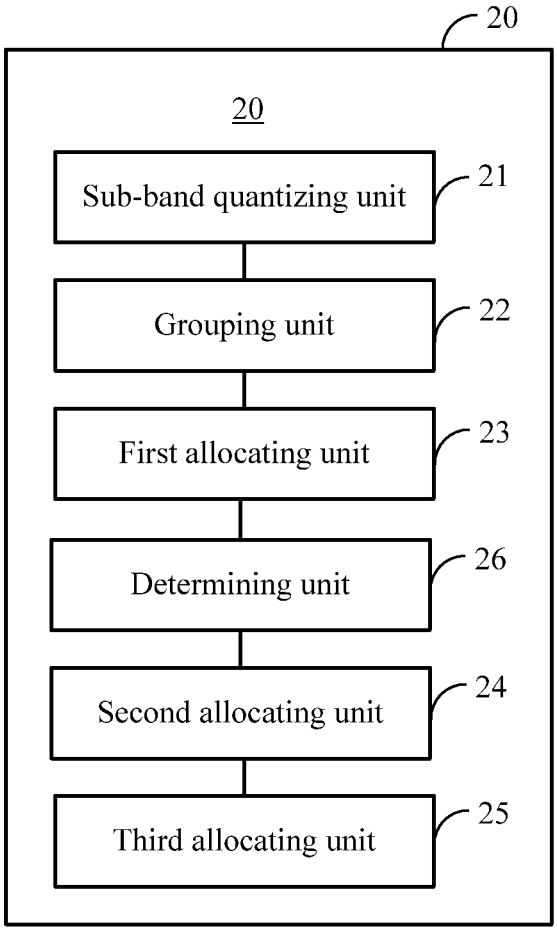
FIG. 4 is another schematic structural diagram of an apparatus for allocating bits of an audio signal according to an embodiment of the present invention.

As shown in FIG. 4, it may be seen that the apparatus 20 for allocating bits of an audio signal may further include a determining unit 26, which is configured to, after the initial inter-group bit allocation and before the secondary inter-group bit allocation, determine, according to a difference between average values of intra-group sub-band normalization factors and/or a bit rate, whether a saturation algorithm for bit allocation is to be used, where an average value of sub-band normalization factors in a group is an average value of sub-band normalization factors of all sub-bands in the group. If a saturation algorithm for bit allocation is to be used, the determining unit 26 determines that a saturation algorithm for bit allocation is to be used; otherwise, the determining unit 26 determines that a weighting algorithm is to be used. As shown in FIG. 4, the third allocating unit 25 is configured to allocate the bits of the audio signal that are allocated to the group to sub-bands in the group.

Figure 5:
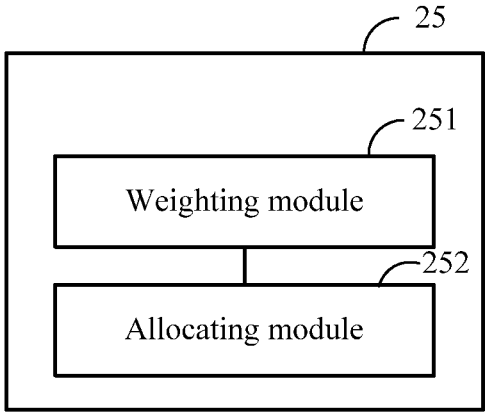
FIG. 5 is a schematic structural diagram of a third allocating unit in an apparatus for allocating bits of an audio signal according to an embodiment of the present invention.

For example, as shown in FIG. 5, the third allocating unit 25 may include a weighting module 251 and an allocating module 252, where the weighting module 251 is configured to weight the sub-band normalization factors to obtain weighted sub-band normalization factors; and the allocating module 252 is configured to allocate the bits of the audio signal that are allocated to the group to some or all of the sub-bands in the group according to the weighted sub-band normalization factors, wherein the some of the sub-bands are selected from all the sub-bands in the group in descending order according to the weighted sub-band normalization factors.

It may be learned from the foregoing that, according to the apparatus for allocating bits of an audio signal in this embodiment of the present invention, relatively stable allocation in a previous frame and a next frame can be ensured by means of grouping, thereby reducing an impact of global allocation on local discontinuity. Therefore, using the grouping manner in this embodiment of the present invention, relatively stable allocation in a previous frame and a next frame is ensured, and bit allocation with different emphases is performed in a group according to signal characteristics, so that allocated bits are all used to quantize important frequency spectrum information, thereby improving coding quality of an audio signal.

Figure 6:
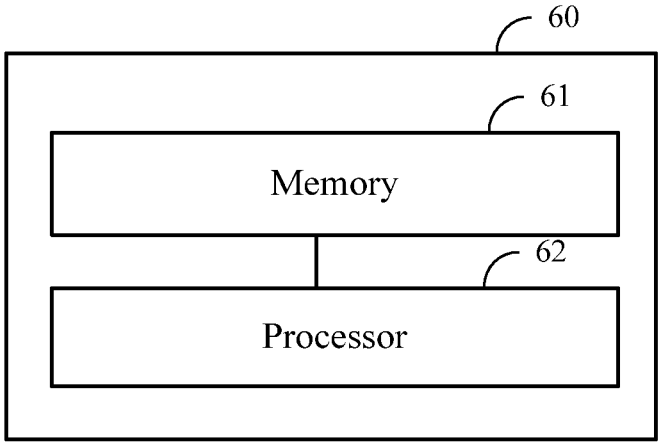
FIG. 6 is still another schematic structural diagram of an apparatus for allocating bits of an audio signal according to an embodiment of the present invention.

In addition, in FIG. 6, an embodiment of the present invention further provides another apparatus 60 for allocating bits of an audio signal. The apparatus 60 includes a memory 61 and a processor 62, where the memory 61 is configured to store code for implementing the steps in the foregoing method embodiments, and the processor 62 is configured to process the code stored in the memory 61.

It may be seen that, according to the apparatus for allocating bits of an audio signal in this embodiment of the present invention, relatively stable allocation in a previous frame and a next frame can be ensured by means of grouping, thereby reducing an impact of global allocation on local discontinuity. In addition, a different threshold parameter may be set for bit allocation in each group, so that bit allocation is more adaptive. Moreover, bit allocation with different emphases is performed in a group according to frequency spectrum signal characteristics. For example, for a quasi-harmonic signal with a centralized frequency spectrum, bits are mainly allocated to sub-bands with high energies, and there is no need to allocate more bits to a sub-band between harmonics; for a signal with a relatively flat frequency spectrum, smoothness between sub-bands is ensured as far as possible during bit allocation, so that allocated bits are all used to quantize important frequency spectrum information.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of the present invention.

It may be clearly understood by a person skilled in the art that, for the purpose of convenient and brief description, for a detailed working process of the foregoing system, apparatus, and unit, refer to a corresponding process in the foregoing method embodiments, and details are not described herein again.

In the several embodiments provided in the present application, it should be understood that the disclosed system, apparatus, and method may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented through some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments.

In addition, functional units in the embodiments of the present invention may be integrated into one processing unit, or each of the units may exist alone physically, or two or more units are integrated into one unit.

When the functions are implemented in the form of a software functional unit and sold or used as an independent product, the functions may be stored in a computer-readable storage medium. Based on such an understanding, the technical solutions of the present invention essentially, or the part contributing to the prior art, or some of the technical solutions may be implemented in a form of a software product. The software product is stored in a storage medium, and includes several instructions for instructing a computer device (which may be a personal computer, a server, or a network device) to perform all or some of the steps of the methods described in the embodiments of the present invention. The foregoing storage medium includes any medium that can store program code, such as a universal serial bus (USB) flash drive, a removable hard disk, a read-only memory (ROM), a random access memory (RAM), a magnetic disk, or an optical disc.

The foregoing descriptions are merely specific implementation manners of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. A method for allocating bits of an audio signal comprising:

dividing a frequency band of an audio signal into multiple sub-bands;

quantizing a sub-band normalization factor of each sub-band;

classifying the multiple sub-bands into multiple groups;

acquiring a sum of intra-group sub-band normalization factors of each group, wherein the sum intra-group sub-band normalization factors is a sum of sub-band normalization factors of all sub-bands in the group;

performing initial inter-group bit allocation according to the sum of intra-group sub-band normalization factors of each group, to determine an initial number of bits of each group;

determining, according to a difference between average values of intra-group sub-band normalization factors or a bit rate, whether a saturation algorithm for bit allocation is to be used, wherein an average value of intra-group sub-band normalization factors is an average value of sub-band normalization factors of all sub-bands in a group;

determining that a saturation algorithm for bit allocation is to be used when a saturation algorithm for bit allocation is to be used;

determining that a weighting algorithm is to be used when a saturation algorithm for bit allocation is not to be used;

performing, based on the initial number of bits of each group, secondary inter-group bit allocation using a saturation algorithm for bit allocation, to allocate coding bits of the audio signal to at least one group, wherein a sum of bits allocated to the at least one group is the number of the coding bits of the audio signal; and allocating the bits of the audio signal that are allocated to the group to sub-bands in the group.

2. The method according to claim 1, wherein performing the secondary inter-group bit allocation using the saturation algorithm for bit allocation comprises:

determining a number of saturation bits of the each group;

determining a bit-saturated group and the number of surplus bits in the bit-saturated group according to the number of saturation bits of each group and the initial number of bits of each group, wherein the number of surplus bits in the bit-saturated group is the number of bits by which the initial number of bits in the bit-saturated group is greater than the number of saturation bits in the bit-saturated group; and allocating the number of surplus bits to a non-bit-saturated group, wherein the bit-saturated group is a group in which the initial number of bits is greater than the number of saturation bits, and wherein the non-bit-saturated group is a group in which the initial number of bits is less than the number of saturation bits.

3. The method according to claim 2, wherein allocating the number of surplus bits to the non-bit-saturated group comprises allocating the number of surplus bits evenly to the non-bit-saturated group.

4. A method for allocating bits of an audio signal comprising:

dividing a frequency band of an audio signal into multiple sub-bands according to spectral coefficients of the audio signal;

quantizing a sub-band normalization factor of each sub-band in the multiple sub-bands;

classifying the multiple sub-bands into multiple groups;

acquiring an average of intra-group sub-band normalization factors of each group wherein the average of intra-group sub-band normalization factors is an average of sub-band normalization factors of all sub-bands in the group;

determining an initial number of bits of each according to the average of intra-group sub-band normalization factors of each group;

determining, according to a difference between average values of intra-group sub-band normalization factors, whether a saturation algorithm for bit allocation is to be used, wherein an average value of intra-group sub-band normalization factors is an average value of sub-band normalization factors of all sub-bands in a group;

determining that a saturation algorithm for bit allocation is to be used when a saturation algorithm for bit allocation is to be used;

determining that a weighting algorithm is to be used when a saturation algorithm for bit allocation is not to be used; and determining, according to the initial number of bits of each group, a secondary number of bits of ach group using a saturation algorithm for bit allocation.

5. The method according to claim 4, wherein determining the secondary number of bits of each group according to the initial number of bits of each group and the saturation algorithm for bit allocation comprises:

determining a number of saturation bits of the each group;

determining a bit-saturated group and the number of surplus bits in the hit-saturated group according to the number of saturation bits of each group and the initial number of bits of each group, wherein the number of surplus bits in the bit-saturated group is the number of bits by which the initial number of bits in the hit-saturated group is greater than the number of saturation bits in the bit-saturated group; and allocating the number of surplus bits to a non-bit-saturated group, wherein the bit-saturated group is a group in which the initial number of bits is greater than the number of saturation bits, and wherein the non-bit-saturated group is a group in which the initial number of bits is less than the number of saturation bits.

6. The method according to claim 5, wherein allocating the number of surplus bits to the non-bit-saturated group comprises allocating the number of surplus bits evenly to the non-bit-saturated group.

7. An apparatus for allocating bits of an audio signal comprising:

a processor configured to:

divide a frequency band of an audio signal into multiple sub-bands:

quantize a sub-band normalization factor of each sub-band;

classify the multip1e sub-bands into multiple groups;

acquire a sum of intra-group sub-band normalization factors of each group, wherein the sum of intra-group sub-band normalization factors is a sum of sub-band normalization factors of all sub-bands in the group;

perform initial inter-group bit allocation according to the sum of intra-group sub-band normalization factors of each group, to determine the initial number of bits of each group;

determine, according to a difference between average values of intra-group sub-band normalization factors or a bit rate, whether a saturation algorithm for bit allocation is to be used, after the initial inter-group bit allocation and before the secondary inter-group bit allocation, wherein an average value of intra-group sub-band normalization factors is an average value of sub-band normalization factors of all sub-bands in a group;

determine that a saturation algorithm for bit allocation is to be used when a saturation algorithm for bit allocation is to be used;

determine that a weighting algorithm is to be used when a saturation algorithm for bit allocation is not to be used;

perform, based on the initial number of bits of each group, secondary inter-group bit allocation using a saturation algorithm for bit allocation, to allocate coding bits of the audio signal to at least one group, wherein a sum of bits allocated to the at least one group is the number of the coding bits of the audio signal; and allocate the bits of the audio signal that are allocated to the group to sub-bands in the group.

8. The apparatus according to claim 7, wherein the processor is further configured to:

determine the number of saturation bits of each group;

determine a bit-saturated group and the number of surplus bits in the bit-saturated group according to the number of saturation bits of each group and the initial number of bits of each group, wherein the number of surplus bits in the bit-saturated group is the number of bits by which the initial number of bits in the bit-saturated group is greater than the number of saturation bits in the bit-saturated group; and allocate the number of surplus bits to a non-bit-saturated group, wherein the bit-saturated group is a group in which the initial number of bits is greater than the number of saturation bits, and wherein the non-bit-saturated group is a group in which the initial number of bits is less than the number of saturation bits.

9. The apparatus according to claim 8, wherein the processor is further configured to allocate the number of surplus bits evenly to the non-bit-saturated group.

10. A method for allocating bits of an audio signal comprising:

dividing spectral coefficients of an audio signal into multiple sub-bands;

quantizing a sub-band normalization factor of each sub-band;

dividing the multiple sub-bands into multiple groups;

obtaining, for each of the multiple groups, an average of the quantized sub-band normalization factors of each of the multiple groups, wherein an average of the quantized sub-hand normalization factors is an average value of sub-band normalization factors of all sub-bands in a group;

performing initial group based bit allocation according to the obtained averages, to determine an initial number of bits of each group;

calculating a difference between the obtained averages;

determining, according to the calculated differences or hit rate, whether a saturation algorithm for bit allocation is to be used;

determining that a saturation algorithm for bit allocation is to be used when a saturation algorithm for bit allocation is to be used;

determining that a weighting algorithm is to be used when a saturation algorithm for bit allocation is not to be used;

performing, according to the initial number of bits of each group, a second stage group based bit allocation using the saturation algorithm for bit allocation; and allocating bits that are allocated to a group with bits allocated after the second stage group based bit allocation to at least one sub-band of the group with bits allocated.

11. The method according to claim 10, wherein the second stage group based bit allocation is performed by:

determining whether a particular group is a bit-saturated group according to the initial number of bits of the particular group;

determining a number of surplus bits of the particular group when the particular group is a bit-saturated group; and allocating the surplus bits of the particular group to a non-bit-saturated group.

12. The method according to claim 11, wherein whether a particular group is a bit-saturated group is determined by:

comparing the initial number of bits of the particular group with a number of saturation bits of the particular group;

determining that the particular group is a bit-saturated group when the initial number of bits of the particular group is greater than the number of saturation bits of the particular group; and determining that the particular group is a non-bit-saturated group when the initial number of bits of the particular group is less than the number of saturation bits of the particular group.

13. The method according to claim 12, wherein the number of surplus bits in the particular group is determined by calculating a difference between the initial number of bits of the particular group and the number of saturation bits of the particular group, wherein the value of the difference is the number of surplus bits of the particular group.

14. The method according to claim 10, wherein the multiple sub-bands are divided into three groups.

15. An apparatus for allocating bits of an audio signal comprising:

a memory for storing processor-executable instructions; and a processor operatively coupled to the memory; the processor being configured to execute the processor-executable instructions to facilitate the following steps:

dividing spectral coefficients of an audio signal into multiple sub-bands;

quantizing a sub-band normalization factor of each sub-band;

dividing the multiple sub-bands into multiple groups;

obtaining, for each of the multiple groups, an average of the quantized sub-band normalization factors of each of the multiple groups, wherein an average of the quantized sub-band normalization factors is an average value of sub-band normalization factors of all sub-bands in a group;

performing initial group based bit allocation according to the obtained averages, to determine an initial number of bits of each group;

calculating a difference between the obtained averages;

determining, according to the calculated differences or bit rate, whether a saturation algorithm for bit allocation is to be used;

determining that a saturation algorithm for bit allocation is to be used when a saturation algorithm for bit allocation is to be used;

determining that a weighting algorithm is to be used when a saturation algorithm for bit allocation is not to be used;

performing, according to the initial number of bits of each group, a second stage group based bit allocation using the saturation algorithm for bit allocation; and allocating bits that are allocated to a group with bits allocated after the second stage group based bit allocation to at least one sub-band of the group with bits allocated.

16. The apparatus according to claim 15, wherein the processor is further configured to execute the processor-executable instructions to facilitate the following:

determining whether a particular group is a bit-saturated group according to the initial number of bits of the particular group;

determining a number of surplus bits of the particular group when the particular group is a bit-saturated group; and allocating the surplus bits of the particular group to a non-bit-saturated group.

17. The apparatus according to claim 16, wherein the processor is further configured to execute the processor-executable instructions to facilitate the following:

comparing the initial number of bits of the particular group with a number of saturation bits of the particular group;

determining that the particular group is a bit-saturated group when he initial number of bits of the particular group is greater than the number of saturation bits of the particular group; and determining that the particular group is a non-bit-saturated group when the initial number of bits of the particular group is less than he number of saturation bits of the particular group.

18. The apparatus according to claim 17, wherein the processor is further configured to execute the processor-executable instructions to facilitate calculating a difference between the initial number of bits of the particular group and the number of saturation bits of the particular group, wherein the value of the difference is the number of surplus bits of the particular group.

19. The apparatus according to claim 15, wherein the multiple sub-bands are divided into three groups.

* * * * *